US008289219B2

(12) United States Patent
Breiter

(10) Patent No.: US 8,289,219 B2
(45) Date of Patent: Oct. 16, 2012

(54) ANTENNA ARRANGEMENT

(75) Inventor: Richard Breiter, Frederiksberg C (DK)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 12/597,923

(22) PCT Filed: May 2, 2007

(86) PCT No.: PCT/IB2007/001821

§ 371 (c)(1),
(2), (4) Date: Jan. 11, 2010

(87) PCT Pub. No.: WO2008/135802

PCT Pub. Date: Nov. 13, 2008

(65) Prior Publication Data

US 2010/0127944 A1 May 27, 2010

(51) Int. Cl.
*H01Q 1/00* (2006.01)

(52) U.S. Cl. ..... 343/729; 343/853

(58) Field of Classification Search ..... 343/700 MS, 343/852, 729, 725, 771, 722, 768, 802, 778, 343/872, 749, 753, 719, 713, 703, 846, 702, 343/727, 730, 742, 795, 829, 770, 895, 844, 343/708, 715, 792.5, 754, 850, 853, 860
See application file for complete search history.

(56) References Cited

U.S. PATENT DOCUMENTS

| | | | | |
|---|---|---|---|---|
| 6,353,170 | B1 | 3/2002 | Eyzaguirre et al. | 84/603 |
| 6,400,963 | B1 * | 6/2002 | Glockler et al. | 455/553.1 |
| 6,476,769 | B1 | 11/2002 | Lehtola | 343/702 |
| 6,759,991 | B2 * | 7/2004 | Boyle | 343/702 |
| 2003/0016179 | A1 | 1/2003 | Boyle | 343/702 |
| 2003/0112185 | A1 | 6/2003 | Fang et al. | 343/700 |
| 2003/0201939 | A1 | 10/2003 | Reece et al. | 343/700 |
| 2004/0227675 | A1 | 11/2004 | Harano | 343/702 |
| 2005/0041624 | A1 | 2/2005 | Hui et al. | 370/335 |
| 2005/0190107 | A1 * | 9/2005 | Takagi et al. | 343/702 |
| 2006/0227052 | A1 * | 10/2006 | Hozouri | 343/700 MS |

FOREIGN PATENT DOCUMENTS

| | | | |
|---|---|---|---|
| CN | 1 569 300 | | 8/2005 |
| CN | 1661855 | | 8/2005 |
| CN | 101189756 | | 5/2008 |
| EP | 1 128 466 | A2 | 8/2001 |
| EP | 1 128 466 | A3 | 8/2001 |
| EP | 1 475 889 | A2 | 11/2004 |
| EP | 1 475 889 | A3 | 11/2004 |
| WO | WO 01/37370 | A1 | 5/2001 |
| WO | WO 02/078124 | A1 | 10/2002 |
| WO | WO 2006/078513 | A2 | 7/2006 |
| WO | WO 2006/078513 | A3 | 7/2006 |

OTHER PUBLICATIONS

Song, C.T.P., et al., "Multiband Multiple Ring Monopole Antennas", IEEE Transactions on Antennas and Propagation, vol. 51, No. 4, Apr. 2003, pp. 722-729.

(Continued)

*Primary Examiner* — Jocob Y Choi
*Assistant Examiner* — Robert Karacsony
(74) *Attorney, Agent, or Firm* — Harrington & Smith

(57) ABSTRACT

An antenna arrangement including a first element operable in a first resonant mode at a first resonant frequency band; and a second element arranged to couple with the first element to enable the first element to resonate in a second resonant mode having a second resonant frequency band, the second element having an impedance at the first resonant frequency band which substantially suppresses coupling between the first element and the second element.

19 Claims, 7 Drawing Sheets

OTHER PUBLICATIONS

Chinese (Patent Application No. 200780053284.9) Office Action dated Mar. 16, 2012.

Translation of Chinese (Patent Application No. 200780053284.9) Office Action dated Mar. 16, 2012.

* cited by examiner

ANTENNA ARRANGEMENT

FIELD OF THE INVENTION

Embodiments of the present invention relate to an antenna arrangement. In particular, embodiments of the present invention relate to an antenna arrangement for a mobile cellular telephone.

BACKGROUND TO THE INVENTION

In recent years, the number of radio frequency bands and protocols in which a wireless device (such as a mobile cellular telephone) may operate has increased and it has become desirable for such devices to be capable of operating in a plurality of these frequency bands and protocols. As a consequence of this, the volume of the antenna arrangements for such devices has correspondingly increased in order to isolate the antennas from one another to reduce interference.

However, there is also a desire in the industry to reduce the size of such devices. Consequently, the antenna arrangement for such a device may limit the extent to which the size of a device may be reduced and/or limit the number of other electronic components which may be housed within a device of a given size.

It would therefore be desirable to provide an alternative antenna arrangement.

BRIEF DESCRIPTION OF THE INVENTION

According to one embodiment of the invention there is provided an antenna arrangement comprising: a first element operable in a first resonant mode at a first resonant frequency band; and a second element arranged to couple with the first element to enable the antenna arrangement to resonate in a second resonant mode having a second resonant frequency band, the second element having an impedance at the first resonant frequency band which substantially suppresses coupling between the first element and the second element.

The antenna arrangement may further comprise a first matching circuit. The first matching circuit may be connected to the first element via a first feed point. The first matching circuit may have an impedance at the first resonant frequency band which enables the first element to operate in the first resonant frequency band.

The first matching circuit may have an impedance at the second resonant frequency band which substantially prevents the transmission and reception of signals therethrough. The first matching circuit may include a low pass filter.

The antenna arrangement may further comprise a second matching circuit. The second matching circuit may be connected to the second element via a second feed point. The second matching circuit may have an impedance at the first resonant frequency band which substantially prevents coupling between the first element and the second element.

The second matching circuit may have an impedance at the second resonant frequency band which enables the transmission and reception of signals therethrough. The second matching circuit may include a high pass filter.

The antenna arrangement may further comprise a ground plane. The second element may be oriented substantially perpendicular relative to the ground plane. The second element may be substantially planar relative to the ground plane.

The first element may include a first end and a second end, opposite to the first end. The first element may be connected to a feed point at the first end. The second element may be positioned adjacent the second end of the first element.

The second element may capacitively couple with first element.

According to another embodiment of the present invention, there is provided an apparatus comprising the antenna arrangement as described in the preceding paragraphs.

According to a further embodiment of the present invention, there is provided a mobile cellular telephone comprising the antenna arrangement as described in the preceding paragraphs.

According to some embodiments of the invention there is provided a method of manufacturing a wireless apparatus comprising: providing a first element that is a resonant antenna at a first frequency band and is connected to a feed for the first frequency band; providing a second element that is connected to a feed for a second frequency band and that has an impedance at the first frequency band which substantially suppresses coupling, and an impedance at the second frequency band which enables coupling; and positioning the first and second elements such that the second element couples with the first element to form an antenna arrangement that is resonant at the second frequency band.

According to one embodiment of the invention there is provided an antenna arrangement comprising: a first element that is resonant at a first frequency band and is connected to a first feed for the first frequency band; a second element that is connected to a second feed for a second frequency band and is arranged to couple with the first element to enable the antenna arrangement to resonate at the second resonant frequency band, the second element having an impedance at the first frequency band which substantially suppresses coupling between the first element and the second element.

BRIEF DESCRIPTION OF THE DRAWINGS

For a better understanding of the present invention reference will now be made by way of example only to the accompanying drawings in which.

DETAILED DESCRIPTION OF EMBODIMENTS OF THE INVENTION

The figures illustrate an antenna arrangement 12 comprising: a first element 22 operable in a first resonant mode at a first resonant frequency band; and a second element 24 arranged to couple with the first element 22 to enable the antenna arrangement 12 to resonate in a second resonant mode having a second resonant frequency band, the second element 24 having an impedance at the first resonant frequency band which substantially suppresses coupling between the first element 22 and the second element 24.

Figure 1A:
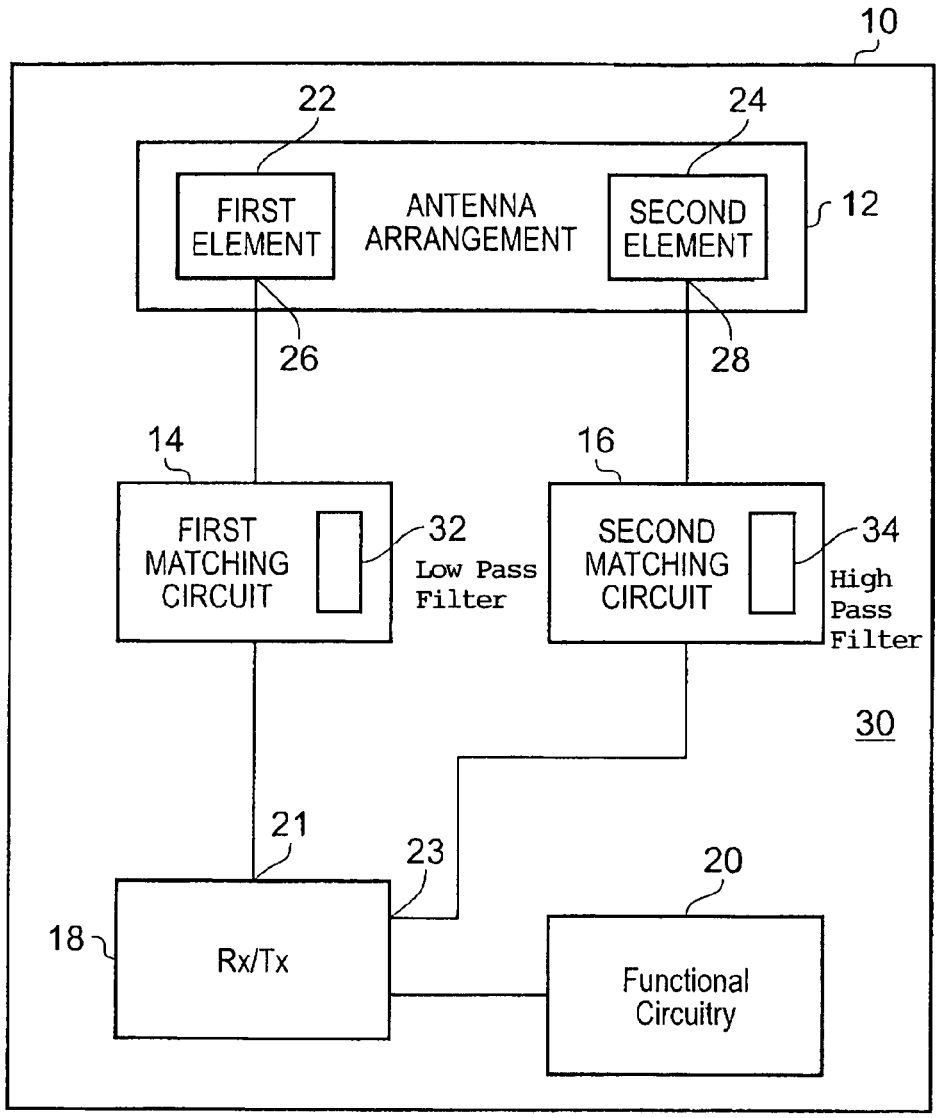
FIG. 1A illustrates a schematic diagram of an apparatus including an antenna arrangement according to one embodiment of the invention.

In more detail, FIG. 1A illustrates an apparatus 10 such as a portable electronic device (for example, a mobile cellular telephone or a personal digital assistant), a cellular base station, other radio communication device or module for such devices.

The apparatus 10 comprises an antenna arrangement 12, a first matching circuit 14, a second matching circuit 16, a transceiver 18 and functional circuitry 20. The antenna arrangement 12 includes a first element 22 and a second element 24. The first matching circuit 14 is connected to the first element 22 via a first feed point 26 and is also connected to a first RF port 21 of the transceiver 18. The second matching circuit 16 is connected to the second element 24 via a second feed point 28 and is also connected to a second RF port 23 of the transceiver 18. The functional circuitry 20 is connected to the transceiver 18 and is operable to provide signals to, and receive signals from the transceiver 18.

In the embodiment where the apparatus 10 is a mobile cellular telephone, the functional circuitry 20 may include a processor, a memory and input/output devices such as a microphone, a loudspeaker and a display. The electronic components that provide the first matching circuit 14, the second matching circuit 16, the transceiver 18 and the functional circuitry 20 are interconnected via a printed wiring board (PWB) 30. In various embodiments the PWB 30 may be used as a ground plane for the antenna arrangement 12. In other embodiments, the antenna arrangement 12 may not have a ground plane.

The first element 22 is an antenna element which is operable to resonate in a first resonant mode at a first resonant frequency band. In various embodiments, the first element 22 is a multi-band antenna element and operable in a plurality of resonant frequency bands. The first element 22 may be any suitable antenna and may be for example, a PIFA antenna, a PILA antenna, a loop antenna or a helical antenna.

The functional circuitry 20 is operable to provide signals to and/or receive signals from the first element 22 via the transceiver 18, first matching circuit 14 and the first feed point 26. The first matching circuit 14 is arranged such that the first element 22 has an impedance at the first resonant frequency band which enables it to operate at that frequency band (it may have an impedance of 50 ohms at the first resonant frequency band for example). The first matching circuit 14 is also arranged such that it has an impedance (substantially different to 50 ohms for example) at a second resonant frequency band (different to the first resonant frequency band) which substantially prevents the transmission and reception of signals having a frequency within the second resonant frequency band through the first matching circuit 14.

In an embodiment where the first resonant frequency band is lower in frequency than the second resonant frequency band, the first matching circuit 14 may include a low pass filter 32 which is arranged to block frequencies greater than the first resonant frequency band.

The second element 24 is arranged in the antenna arrangement 12 such that it capacitively couples with the first element 22 to enable the antenna arrangement 12 (i.e. the first element 22 and the second element 24 in this embodiment) to resonate in a second resonant mode having a second resonant frequency band. The second element 24 in isolation (i.e. without the first element 22) is unable to transmit and receive signals in the first resonant frequency band or the second resonant frequency band.

The second matching circuit 16 is arranged such that the second element 24 has an impedance (which may be 50 ohms for example) at the second resonant frequency band which enables the second element 24 to capacitively couple with the first element 22. Additionally, the impedance of the second matching circuit 16 enables the transmission and reception of signals within the second resonant frequency band through the second matching circuit 16.

The second matching circuit 16 is also arranged such that the second element 24 has an impedance (substantially different to 50 ohms for example) at the first resonant frequency band which substantially prevents the second element from coupling with the first element 22. In the embodiment where the first resonant frequency band is lower in frequency than the second resonant frequency band, the second matching circuit may include a high pass filter 34 which is arranged to block frequencies which are lower than the second resonant frequency band.

Embodiments of the present invention provide an advantage in that the coupling with the second element 24 enables the first element 22 to operate in its second resonant mode and thereby provide an additional resonant frequency band. Additionally, since the second element 24 has an impedance at the first resonant frequency band which substantially suppresses coupling between the first element 22 and the second element 24, the second element 22 does not affect the performance of the first element 22 when the first element 22 is operating in the first resonant frequency band.

Figure 1B:
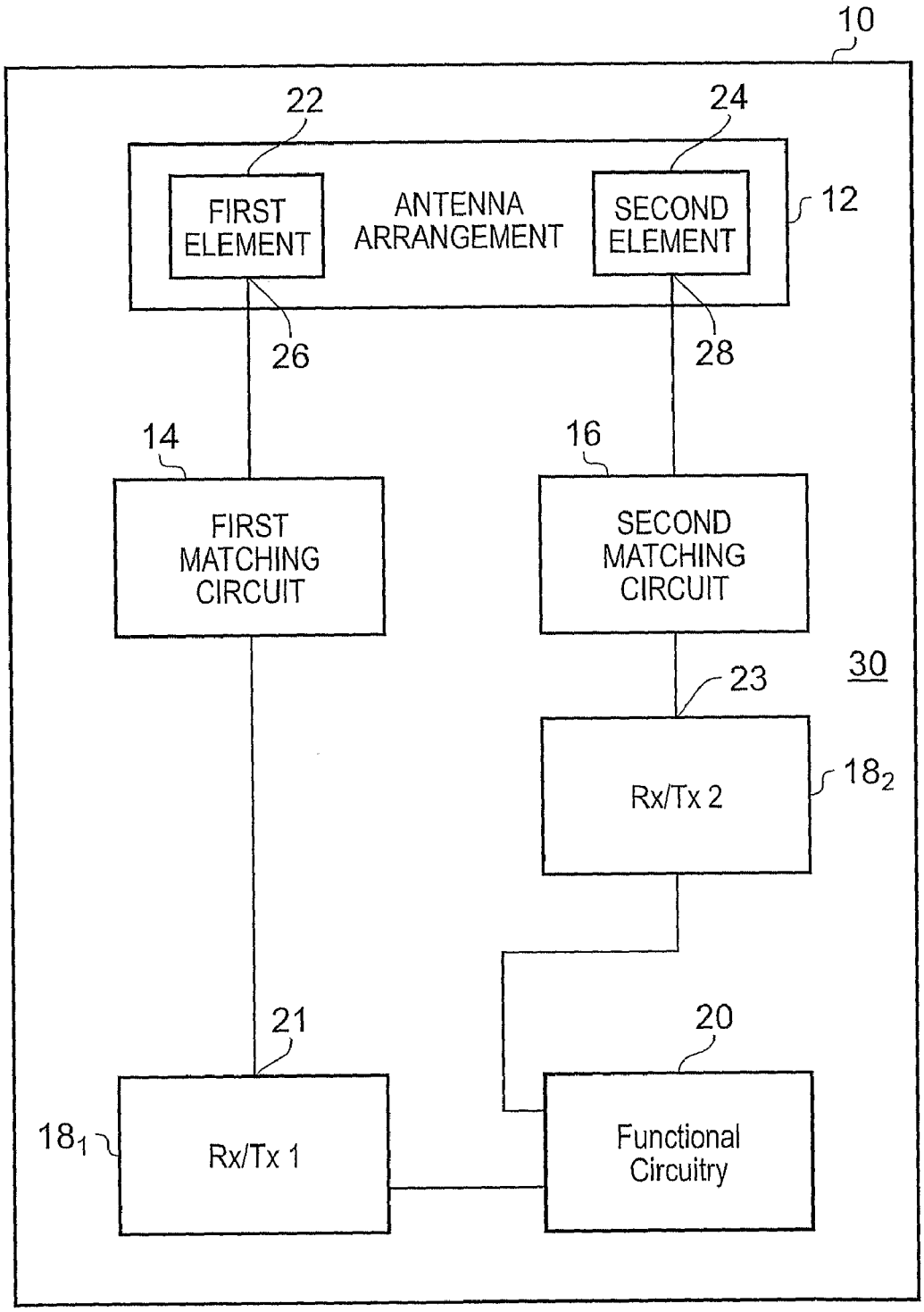
FIG. 1B illustrates a schematic diagram of an apparatus including an antenna arrangement according to another embodiment of the invention.

FIG. 1B illustrates a schematic diagram of an apparatus 10 including an antenna arrangement 12 according to another embodiment of the invention. The apparatus 10 is similar to the apparatus illustrated in FIG. 1A and where the features are similar, the same reference numerals are used.

The apparatus illustrated in FIG. 1B differs from the apparatus illustrated in FIG. 1A in that it comprises a first transceiver $\mathbf{18}_1$ connected to the first matching circuit 14 and to the functional circuitry 20, and a second transceiver $\mathbf{18}_2$ connected to the second matching circuit 16 and to the functional circuitry 20. The first transceiver $\mathbf{18}_1$ and the second transceiver $\mathbf{18}_2$ may be in the same integrated circuit package or in different integrated circuit packages.

The first transceiver $\mathbf{18}_1$ operates according to a different radio communication protocol to the second transceiver $\mathbf{18}_2$. For example, the first transceiver $\mathbf{18}_1$ may be for cellular communications (e.g. GSM) whereas the second transceiver $\mathbf{18}_2$ may be for GPS.

Figure 2:
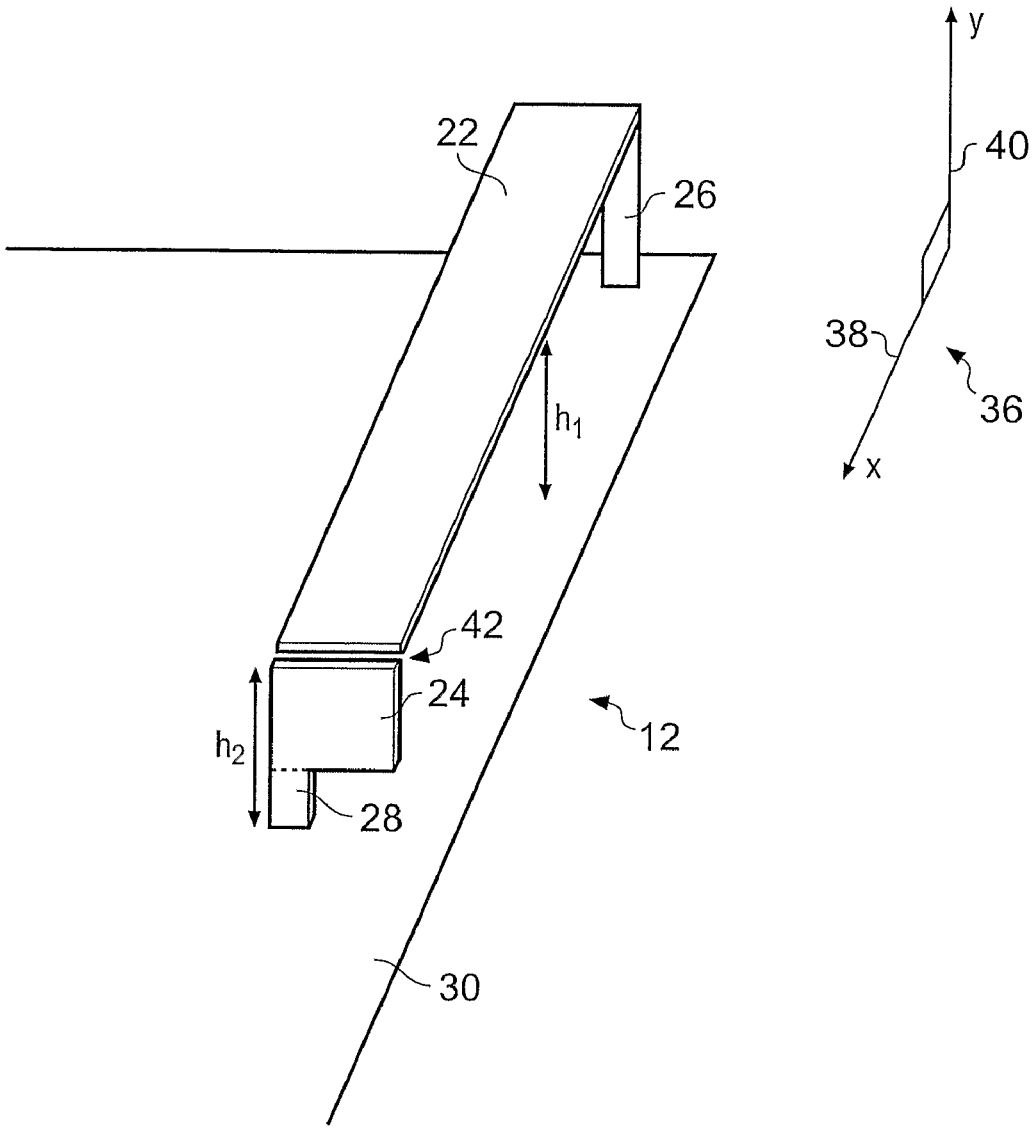
FIG. 2 illustrates a perspective diagram of an antenna arrangement according to an embodiment of the invention.

FIG. 2 illustrates a perspective diagram of an antenna arrangement 12 according to one embodiment of the invention. A Cartesian coordinate system 36 is provided in the figure which has an X axis 38 and a Y axis 40 which are orthogonal with respect to one another.

The first element 22 is a Planar Inverted L Antenna which extends from the first feed point 26 in the +X direction until its end point 42. The first element 22 is planar with respect to the ground plane 30 and has a height $h_1$ above the ground plane 30 measured in the +Y direction.

The second element 24 extends from the second feed point 28 in the +Y direction to a height $h_2$ and is therefore oriented perpendicularly relative to the ground plane 30. In this embodiment, the height of the second element $h_2$ is substantially equal to the height $h_1$ of the first element 24.

The second element 24 is positioned adjacent the end 42 of the first element 22. When the first element 22 is operating, the electric field E of the first element 22 is at its maximum at the end 42. Consequently, one advantage of positioning the second element 24 adjacent the end 42 of the first element 22 is that the capacitive coupling between the elements 22 and 24 is maximised.

Another advantage provided by the antenna arrangement 12 illustrated in FIG. 2 is that it occupies a relatively low volume. Since the second element 24 is oriented perpendicular to the ground plane 30 and the first element 22 and does not extend beyond the height $h_1$ of the first element 22, it occupies very little volume. Consequently, an additional resonant mode may be excited in the first element 22 with little extra volume required for the antenna arrangement 12.

Figure 3:
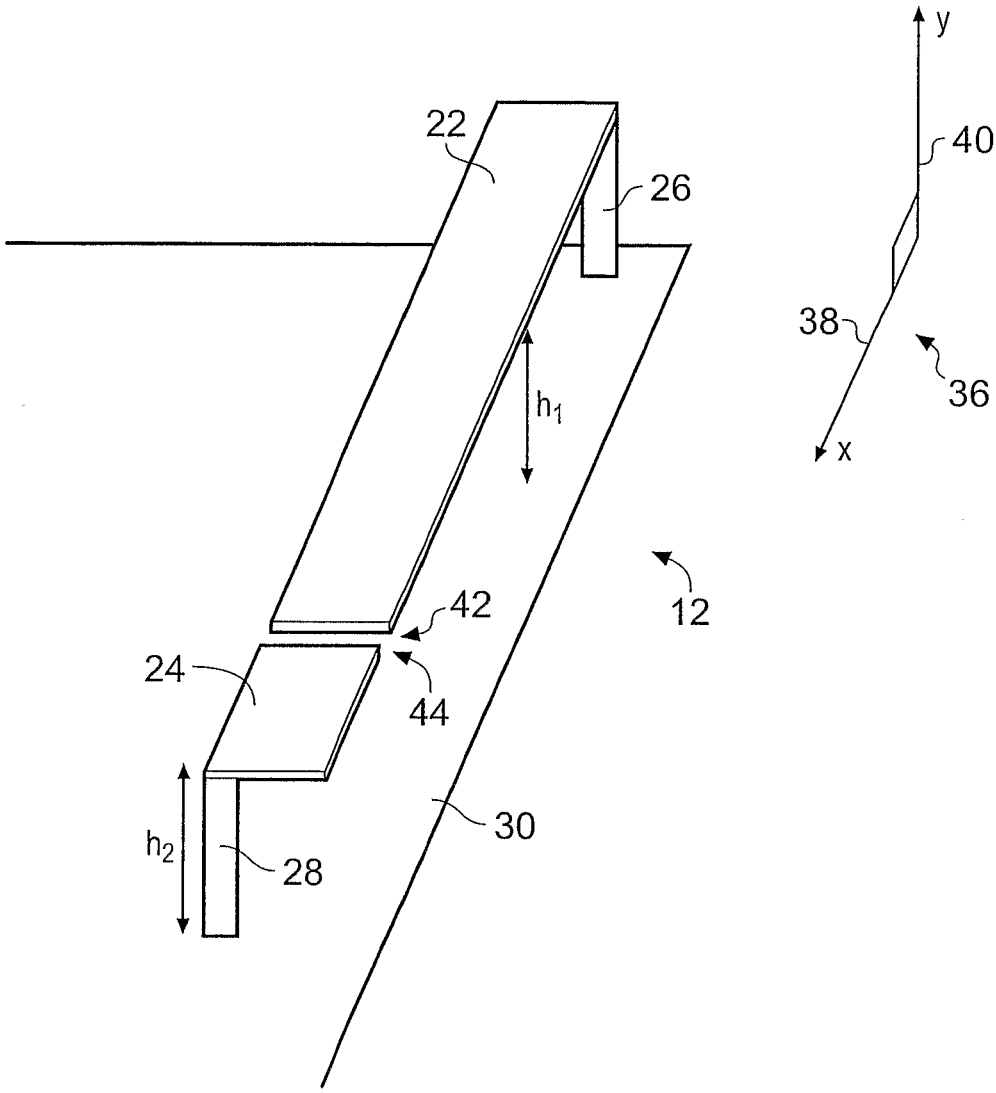
FIG. 3 illustrates a perspective diagram of an antenna arrangement according to another embodiment of the invention.

FIG. 3 illustrates a perspective diagram of an antenna arrangement 12 according to another embodiment of the invention. The embodiment illustrated in FIG. 3 is similar to the embodiment illustrated in FIG. 2 and where the features are similar, the same reference numerals are used.

The embodiment illustrated in FIG. 3 differs from the embodiment illustrated in FIG. 2 in that the second element 24 extends from the second feed point 28 in the −X direction until its end point 44 and is generally planar with respect to the ground plane 30 and may be coplanar with the first element 22. The end point 44 of the second element 24 is positioned adjacent the end 42 of the first element 22.

Figure 4:
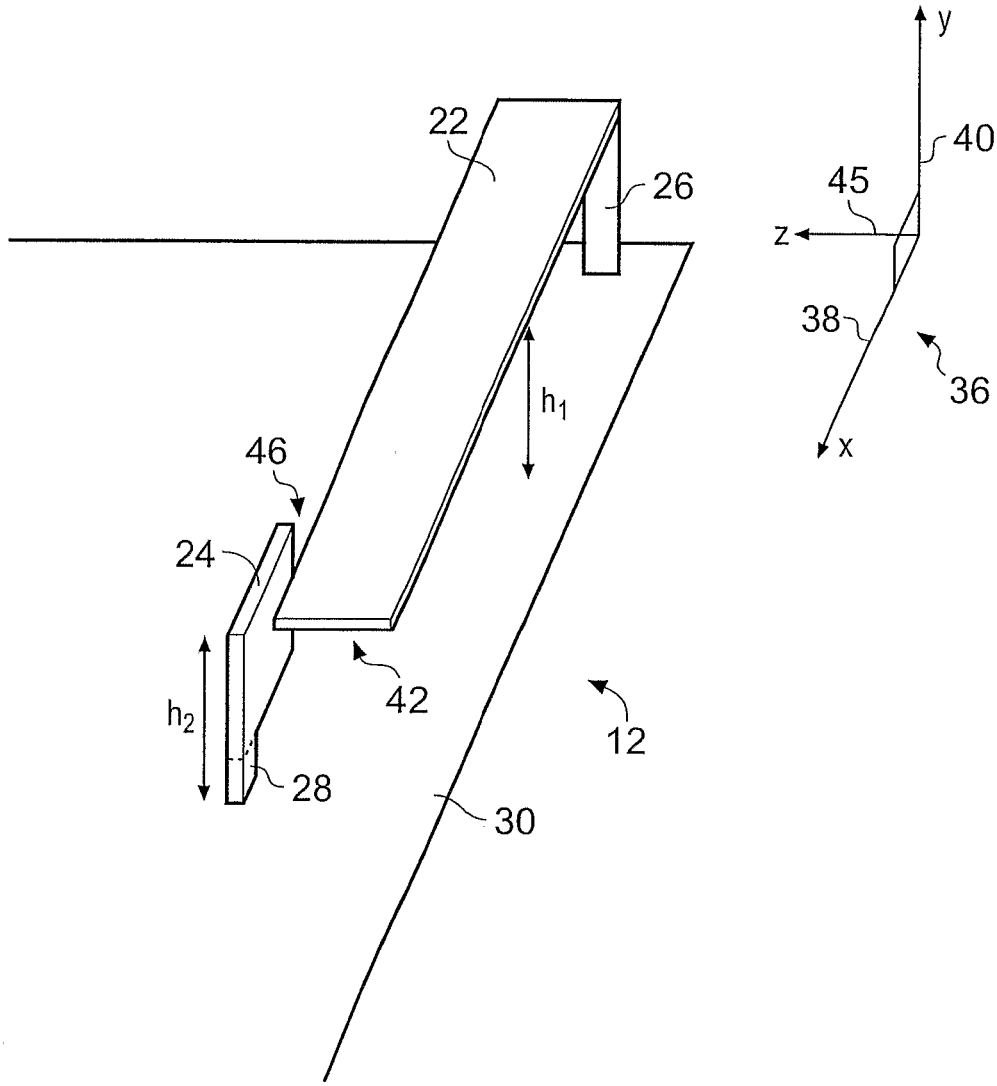
FIG. 4 illustrates a perspective diagram of an antenna arrangement according to a further embodiment of the invention.

FIG. 4 illustrates a perspective diagram of antenna arrangement 12 according to a further embodiment of the invention. The embodiment illustrated in FIG. 4 is similar to the embodiment illustrated in FIG. 2 and where the features are similar, the same reference numerals are used.

It should be appreciated that the Cartesian coordinate system 36 illustrated in FIG. 4 also has a Z axis 45 which is orthogonal to the x axis 38 and to the y axis 40.

The embodiment illustrated in FIG. 4 differs from the embodiment illustrated in FIG. 2 in that the second element 24 is positioned adjacent a side 46 of the first element 22 and proximal to the end 42 of the first element 22. In the illustrated embodiment, the side 46 of the first element 22 is the side of the first element 22 which has the highest positive z axis value.

Figure 5:
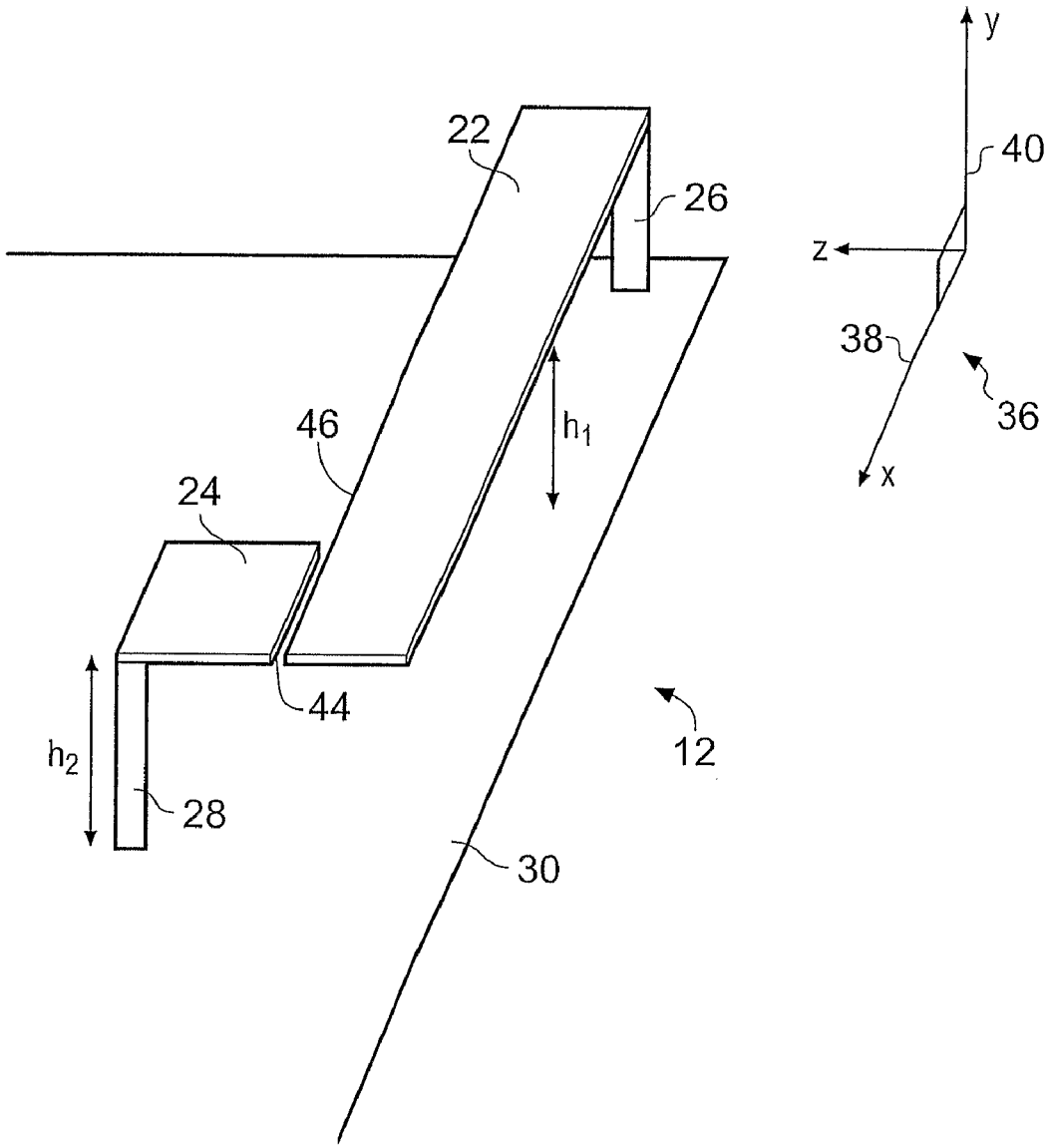
FIG. 5 illustrates a perspective diagram of an antenna arrangement according to another embodiment of the invention.

FIG. 5 illustrates a perspective diagram of an antenna arrangement 12 according to another embodiment of the invention. The embodiment illustrated in FIG. 5 is similar to the embodiment illustrated in FIG. 4 and where the features are similar, the same reference numerals are used.

The embodiment illustrated in FIG. 5 differs from the embodiment illustrated in FIG. 4 in that the second element 24 extends from the second feed point 28 in the −Z direction until its end point 44 and is generally planar with respect to the ground plane 30 and may be coplanar with the first element 22. The end point 44 of the second element 24 is positioned adjacent the side 46 of the first element 22 and proximal to the end 42 of the first element 22.

It should be appreciated that the embodiments illustrated in FIGS. 2, 3, 4 and 5 provide examples of how the first element 22 and the second element 24 may be arranged. In other embodiments of the invention, the first element 22 and the second element 24 may have alternative arrangements which provide coupling between the first element 22 and the second element 24.

Figure 6:
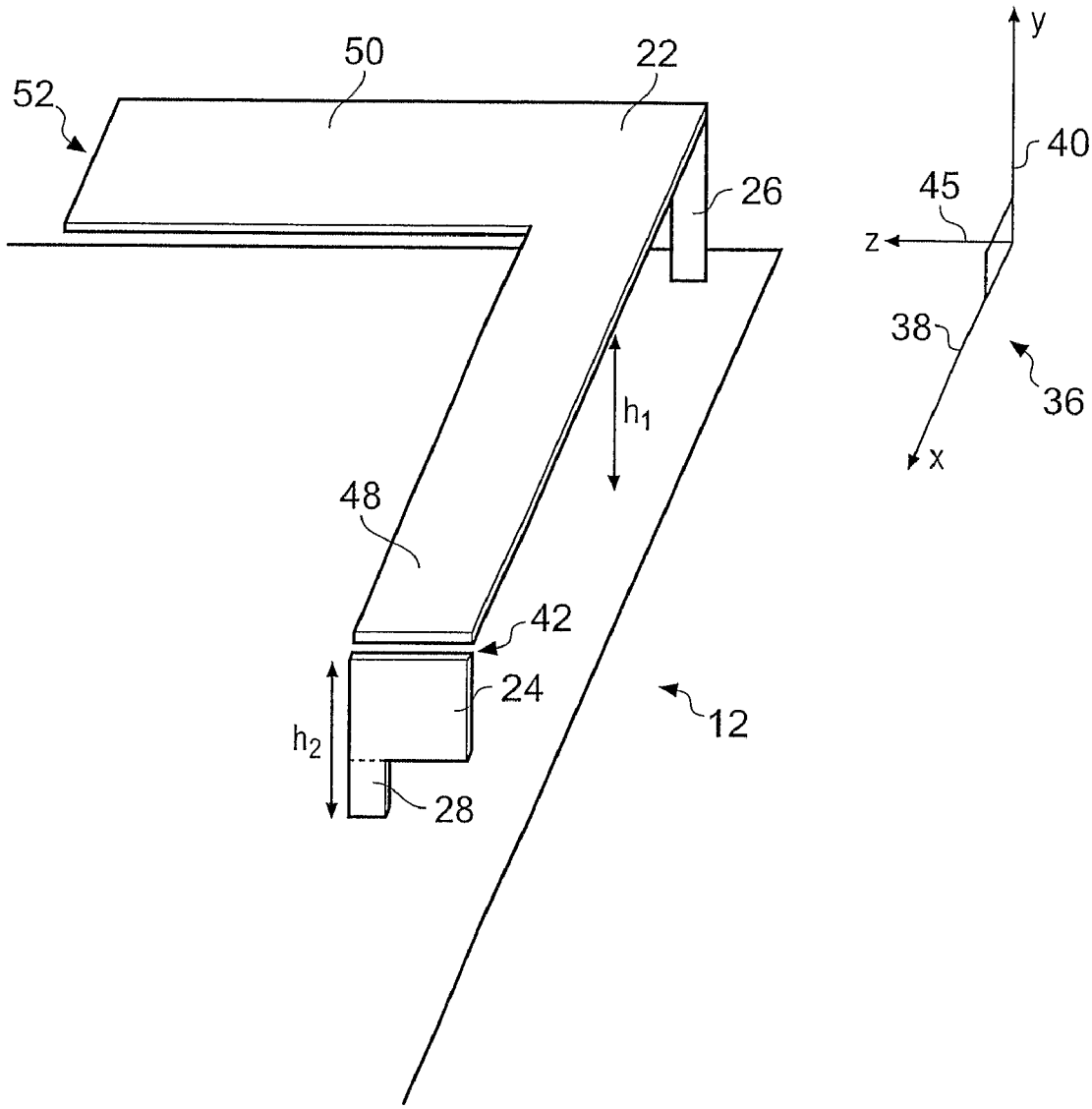
FIG. 6 illustrates a perspective diagram of an antenna arrangement according to a further embodiment of the invention.

FIG. 6 illustrates a perspective diagram of an antenna arrangement 12 according to a further embodiment of the invention. The embodiment illustrated in FIG. 6 is similar to the embodiment illustrated in FIG. 2 and where the features are similar, the same reference numerals are used.

It should be appreciated that the Cartesian coordinate system 36 illustrated in FIG. 6 also has a Z axis 45 which is orthogonal to the x axis 38 and to the y axis 40.

The embodiment illustrated in FIG. 6 differs from the embodiment illustrated in FIG. 2 in that the first element 22 is an L-shaped PILA. The first element 22 has a first portion 48 which extends from the feed point 26 in the +X direction until an end 42 and a second portion 50 which extends from the feed point 26 in the +Z direction until an end 52.

The first portion 48 and the second portion 50 of the first element 22 have different electrical lengths which allow them to resonate in different resonant frequency bands. For example, in the illustrated embodiment, the first portion 48 has a smaller electrical length than the second portion 50. Consequently, the first portion 48 resonates in a higher frequency band (e.g. GPS 1575.42 MHz) than the second portion 50 (e.g. GSM900).

The second element 24 is positioned adjacent the end 42 of the first portion 48 of the first element 22. The second element 24 is arranged to couple with the first portion 48 and cause it to resonate in its resonant frequency band. The first feed point 26 causes the second portion 50 to resonate in its resonant frequency band.

This embodiment provides an advantage in that the two resonant modes of the first element 22 can be tuned independently of one another by changing the lengths of the first portion 48 and the second portion 50.

Additionally, the same structure may be used to provide the first resonant mode and the second mode, i.e. the two feed points 26 and 28 excite different modes in the same structure since the first feed point 26 excites one mode (e.g. GSM900 mode) and the second feed point 28 excites another mode (e.g. GPS mode).

In one embodiment (with respect to FIGS. 1B, 2, 3, 4, 5 and 6), the first resonant frequency band is GSM 900 MHz and the second resonant frequency band is GPS 1.5 GHz. However, it should be appreciated that embodiments of the present invention are not limited to these frequency bands and protocols and may use any radio frequency band or protocol. For example, the different frequency bands and protocols may include (but are not limited to) DVB-H 470 to 702 MHz, US-GSM 850 (824-894 MHz); EGSM 900 (880-960 MHz); GPS 1575.42 MHz, PCN/DCS1800 (1710-1880 MHz); US-WCDMA1900 (1850-1990) band; WCDMA21000 band (Tx: 1920-19801 Rx: 2110-2180); PCS1900 (1850-1990 MHz); 2.5 GHz WLAN/BT, 5 GHz WLAN, DRM (0.15-30.0 MHz), FM (76-108 MHz), AM (0.535-1.705 MHz), DVB-H [US] (1670-1675 MHz), WiMax (2300-2400 MHz, 2305-2360 MHz, 2496-2690 MHz, 3300-3400 MHz, 3400-3800 MHz, 5150-5875 MHz), RFID (LF [125-134 kHz], HF[13.56 MHz]) UHF (433 MHz, 865-956 MHz or 2.45 GHz), and UWB 3.0 to 10.6 GHz.

Although embodiments of the present invention have been described in the preceding paragraphs with reference to various examples, it should be appreciated that modifications to the examples given can be made without departing from the scope of the invention as claimed. For example, the first matching circuit 14 may include a diplexer connected to a matching circuit for the first resonant frequency band and connected to another matching circuit for the second resonant frequency band.

A lumped capacitor may be connected to the ends of the first element 22 and the second element 24 (e.g. between the ends 42 and 44 illustrated in FIG. 3) to improve the coupling between the first element 22 and the second element 24.

High permittivity material may be provided between the ends of the first element 22 and the second element 24 (e.g. between the ends 42 and 44 illustrated in FIG. 3). This may provide an advantage in that it may allow the gap between the ends 42 & 44 of the first element 22 and second element 24 respectively to be increased which may make the antenna arrangement 12 less sensitive to production tolerances and therefore easier to construct.

The embodiments illustrated in FIGS. 3 and 5 may be adapted so that the height $h_2$ of the second element 24 is less than the height $h_1$ of the first element 22 and so that the second element 24 at least partly extends under the first element 22. This arrangement may improve the coupling between the first element 22 and the second element 24.

It should be appreciated that an antenna arrangement 12 may comprise a plurality of second elements 24 for providing the same function and advantages as described above. Furthermore, more than one second element 24 may be provided for coupling to a resonant element such as the first element 22.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. An apparatus comprising:

a first antenna element configured to operate in a first resonant mode at a first resonant frequency band; and a second element configured to capacitively couple with the first antenna element to enable the apparatus to resonate in a second resonant mode having a second resonant frequency band, the second element having an impedance at the first resonant frequency band which substantially suppresses coupling between the first antenna element and the second element.

2. An apparatus as claimed in claim 1, further comprising a first matching circuit, connected to the first antenna element via a first feed point, having an impedance at the first resonant frequency band which is configured to enable the first antenna element to operate in the first resonant frequency band.

3. An apparatus as claimed in claim 2, wherein the first matching circuit has an impedance at the second resonant frequency band which is configured to substantially prevent the transmission and reception of signals therethrough.

4. An apparatus as claimed in claim 3, wherein the first matching circuit includes a low pass filter.

5. An apparatus as claimed in claim 1, further comprising a second matching circuit, connected to the second element via a second feed point, having an impedance at the first resonant frequency band which is configured to substantially prevent coupling between the first antenna element and the second element.

6. An apparatus as claimed in claim 5, wherein the second matching circuit has an impedance at the second resonant frequency band which is configured to enable the transmission and reception of signals therethrough.

7. An apparatus as claimed in claim 6, wherein the second matching circuit includes a high pass filter.

8. An apparatus as claimed in claim 1, further comprising a ground plane, wherein the second element is oriented substantially perpendicular relative to the ground plane.

9. An apparatus as claimed in claim 1, further comprising a ground plane, wherein the second element is substantially planar relative to the ground plane.

10. An apparatus as claimed in claim 1, wherein the first antenna element includes a first end and a second end, opposite to the first end, the first antenna element being connected to a feed point at the first end and the second element being positioned adjacent the second end of the first antenna element.

11. An apparatus as claimed in claim 1, wherein the apparatus is an antenna arrangement.

12. A module for a wireless device comprising the apparatus as claimed in claim 1.

13. A radio communication device comprising the apparatus as claimed in claim 1.

14. A method comprising:

providing a first antenna element configured to operate in a first resonant mode at a first resonant frequency band;

providing a second element configured to have an impedance at the first frequency band which substantially suppresses coupling, and an impedance at a second frequency band which enables coupling; and positioning the first antenna element and the second element so that the second element is configured to capacitively couple with the first antenna element to form an apparatus that is resonant at the second frequency band.

15. An antenna arrangement comprising:

a first antenna element that is resonant at a first frequency band and is connected to a first feed for the first frequency band;

a second element that is connected to a second feed for a second frequency band and is configured to capacitively couple with the first antenna element to enable the antenna arrangement to resonate at the second resonant frequency band, the second element having an impedance at the first frequency band which substantially suppresses coupling between the first antenna element and the second element.

16. A method as claimed in claim 14, further comprising providing a first matching circuit, connected to the first antenna element via a first feed point, having an impedance at the first resonant frequency band which is configured to enable the first antenna element to operate in the first resonant frequency band.

17. A method as claimed in claim 14, further comprising providing a second matching circuit, connected to the second element via a second feed point, having an impedance at the first resonant frequency band which is configured to substantially prevent coupling between the first antenna element and the second element.

18. A method as claimed in claim 14, further comprising providing a ground plane, wherein the second element is oriented substantially perpendicular relative to the ground plane or wherein the second element is substantially planar relative to the ground plane.

19. A method as claimed in claim 14, wherein the first antenna element includes a first end and a second end, opposite to the first end, the first antenna element being connected to a feed point at the first end and the second element being positioned adjacent the second end of the first antenna element.

* * * * *